US008763672B2

(12) United States Patent
Smart et al.

(10) Patent No.: US 8,763,672 B2
(45) Date of Patent: Jul. 1, 2014

(54) METHODS, APPARATUSES, AND SYSTEMS FOR DRIVING A MOVABLE PARTITION WITH A LEAD DRIVE BOX

(75) Inventors: R. Scott Smart, Sandy, UT (US); Tracy M. Knight, Kearns, UT (US)

(73) Assignee: Won-Door Corporation, Salt Lake City, UT (US)

( * ) Notice: Subject to any disclaimer, the term of this patent is extended or adjusted under 35 U.S.C. 154(b) by 351 days.

(21) Appl. No.: 13/169,299

(22) Filed: Jun. 27, 2011

(65) Prior Publication Data

US 2012/0325413 A1 Dec. 27, 2012

(51) Int. Cl.
*E05F 15/14* (2006.01)

(52) U.S. Cl.
USPC ..... 160/84.02; 160/188

(58) Field of Classification Search
USPC ..... 160/84.02, 84.08, 188, 199
See application file for complete search history.

(56) References Cited

U.S. PATENT DOCUMENTS

| | | | | |
|---|---|---|---|---|
| 3,289,741 | A * | 12/1966 | Gossling | 160/188 |
| 3,414,040 | A * | 12/1968 | Harris | 160/188 |
| 3,577,679 | A | 5/1971 | Petterborg | |
| 3,599,702 | A * | 8/1971 | Bedard | 160/44 |
| 3,720,254 | A | 3/1973 | Smart | |
| 3,807,480 | A * | 4/1974 | Smart | 160/1 |
| 4,133,364 | A * | 1/1979 | Smart | 160/199 |
| 4,834,161 | A * | 5/1989 | Johnson et al. | 160/84.08 |
| 4,957,600 | A | 9/1990 | Carlson et al. | |
| 5,279,436 | A | 1/1994 | Elliott et al. | |
| 5,625,266 | A | 4/1997 | Stark | |
| 5,950,373 | A | 9/1999 | von Hoff et al. | |
| 6,209,171 | B1 | 4/2001 | Pelletier et al. | |
| 6,615,894 | B1 | 9/2003 | McKeon | |
| 6,662,848 | B2 | 12/2003 | Goodman et al. | |
| 7,478,663 | B2 | 1/2009 | Goodman et al. | |
| 7,513,293 | B2 | 4/2009 | Goodman et al. | |
| 2003/0155081 | A1 * | 8/2003 | Goodman et al. | 160/84.02 |
| 2006/0144529 | A1 * | 7/2006 | Hemphill | 160/188 |
| 2008/0197808 | A1 * | 8/2008 | Banta et al. | 320/134 |
| 2008/0244991 | A1 * | 10/2008 | Coleman et al. | 52/71 |
| 2011/0036016 | A1 | 2/2011 | Knight et al. | |

FOREIGN PATENT DOCUMENTS

| | | |
|---|---|---|
| WO | 2005098189 A1 | 10/2005 |
| WO | 2010089570 | 8/2010 |

OTHER PUBLICATIONS

PCT International Search Report and Written Opinion of the International Searching Authority for PCT/US2012/043513, dated Sep. 24, 2012, 9 pages.

* cited by examiner

*Primary Examiner* — David Purol
(74) *Attorney, Agent, or Firm* — TraskBritt

(57) ABSTRACT

Movable partition systems include a movable partition engaged with and movable along a longitudinal track and a lead drive box coupled to the movable partition and engaged with the track. The lead drive box is configured to move along the track and move the movable partition along the track. The lead drive box includes a trolley for disposition within the track, a motor coupled to the lead drive box, and a rotatable drive member coupled to the lead drive box and the motor. The rotatable drive member engages an elongated drive member extending along the track to motivate the lead drive box and the movable partition attached thereto along the track when engaged with the motor and the motor is rotating. An electronics module disposed within the lead drive box is configured for controlling operation of the motor responsive to signals originating from sources carried by the lead drive box.

31 Claims, 9 Drawing Sheets

METHODS, APPARATUSES, AND SYSTEMS FOR DRIVING A MOVABLE PARTITION WITH A LEAD DRIVE BOX

TECHNICAL FIELD

Embodiments of the present invention are directed to the field of movable partitions used for partitioning space, as sound barriers, as fire barriers, security barriers, and for various other applications.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the movable partition in a header assembly, until the partition extends a desired distance across the room.

When deployed, a leading end of the movable partition, often defined by a component known as a lead post, complementarily engages another structure, such as a wall, a post, or a lead post of another door.

Automatic extension and retraction of the movable partition may be accomplished through the use of a motor located in a pocket formed in the wall of a building in which the movable partition is stored when in a retracted or folded state. The motor, which remains fixed in place within the pocket, may be used to drive extension and retraction of the movable partition. A motor for automatically extending and retracting a movable partition may also be mounted within the movable partition itself, such that the motor travels with the movable partition as the movable partition is extended and retracted using the motor.

The inventors have appreciated that there is a need for apparatuses, and methods for moving and controlling a movable partition with a lead drive box bearing a motor and control components.

BRIEF SUMMARY

Embodiments of the present disclosure include apparatuses, and methods for moving and controlling a movable partition with a lead drive box bearing a motor and control components.

In some embodiments, a lead drive box for use with a movable partition includes at least one trolley coupled to the lead drive box and configured for disposition at least partially within a track extending longitudinally between a first end and a second end. A motor is coupled to the lead drive box. A rotatable drive member is coupled to the lead drive box and operably coupled to the motor. The rotatable drive member is configured for engaging a fixed drive member extending along the track to motivate the lead drive box and the movable partition attached thereto along the track when engaged with the motor and the motor is rotating. An electrical components module is disposed within the lead drive box and is configured for controlling operation of the motor responsive to one or more signals originating from one or more sources carried by the lead drive box. A casing forming at least a partial enclosure for the lead drive box is coupled to the at least one trolley and is configured for bearing the electrical components module and the one or more signal sources.

In other embodiments, a movable partition system includes a movable partition engaged with and movable along a track extending longitudinally between a first end and a second end and a lead drive box coupled to the movable partition and the track. The lead drive box is configured to move along the track and move the movable partition along the track. The lead drive box includes at least one trolley coupled to the lead drive box and is configured for disposition at least partially within the track. A motor is coupled to the lead drive box. A rotatable drive member is coupled to the lead drive box and operably coupled to the motor. The rotatable drive member is configured for engaging a fixed drive member extending along the track to motivate the lead drive box and the movable partition attached thereto along the track when engaged with the motor and the motor is rotating. An electrical components module is disposed within the lead drive box and is configured for controlling operation of the motor responsive to one or more signals originating from one or more sources carried by the lead drive box. A casing forming at least a partial enclosure for the lead drive box is coupled to the at least one trolley and is configured for bearing the electrical components module and the one or more signal sources.

In additional embodiments, the present disclosure includes methods of moving a movable partition along a track. The methods include engaging a rotatable drive member carried by a lead drive box with a fixed drive member extending along the track and having fixed, laterally offset opposite ends. A motor carried by the lead drive box is actuated to drive rotation of the rotatable drive member to move the lead drive box and the movable partition attached thereto along the track. Operation of the motor is controlled with an electrical components module carried by the lead drive box and responsive to one or more signals originating from one or more sources carried by the lead drive box.

BRIEF DESCRIPTION OF THE SEVERAL VIEWS OF THE DRAWINGS

While the specification concludes with claims particularly pointing out and distinctly claiming that which is regarded as the present disclosure, the advantages of this disclosure may be more readily ascertained from the description of embodiments of the disclosure when read in conjunction with the accompanying drawings, in which:

DETAILED DESCRIPTION

Figure 1A:
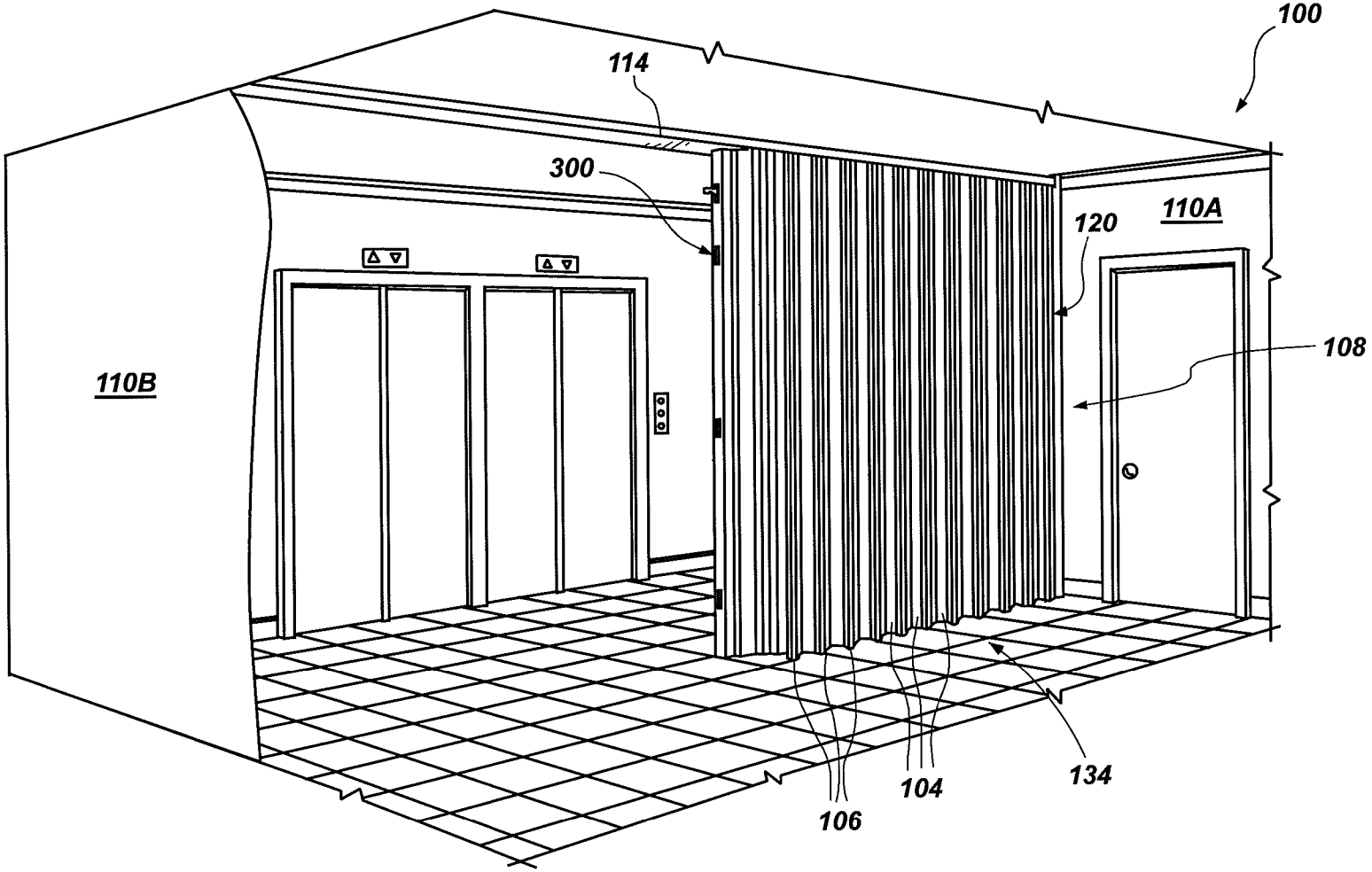
FIGS. 1A-1C show a perspective view, a side view and a top view, respectively, of a system with a movable partition in accordance with an embodiment of the present disclosure.

In the following description, reference is made to the accompanying drawings in which is shown, by way of illustration, specific embodiments of the present disclosure. The embodiments are intended to describe aspects of the disclosure in sufficient detail to enable those skilled in the art to practice the invention. Other embodiments may be utilized and changes may be made without departing from the scope of the disclosure. The following detailed description is not to be taken in a limiting sense, and the scope of the present invention is defined only by the appended claims.

Furthermore, specific implementations shown and described are only examples and should not be construed as the only way to implement or partition the present disclosure into functional elements unless specified otherwise herein. It will be readily apparent to one of ordinary skill in the art that the various embodiments of the present disclosure may be practiced by numerous other partitioning solutions.

In the following description, elements, circuits, and functions may be shown in block diagram form in order not to obscure the present disclosure in unnecessary detail. Additionally, block definitions and partitioning of logic between various blocks is exemplary of a specific implementation. It will be readily apparent to one of ordinary skill in the art that the present disclosure may be practiced by numerous other partitioning solutions. Those of ordinary skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal.

The various illustrative logical blocks, modules, and circuits described in connection with the embodiments disclosed herein may be implemented or performed with a general purpose processor, a special purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

Also, it is noted that the embodiments may be described in terms of a process that may be depicted as a flowchart, a flow diagram, a structure diagram, or a block diagram. Although a process may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on computer-readable media. Computer-readable media includes both computer storage media and communication media including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. In addition, unless stated otherwise, a set of elements may comprise one or more elements.

Embodiments of the present disclosure include apparatuses, and methods for moving and controlling a movable partition with a lead drive box bearing a motor and control components.

Figure 1B:
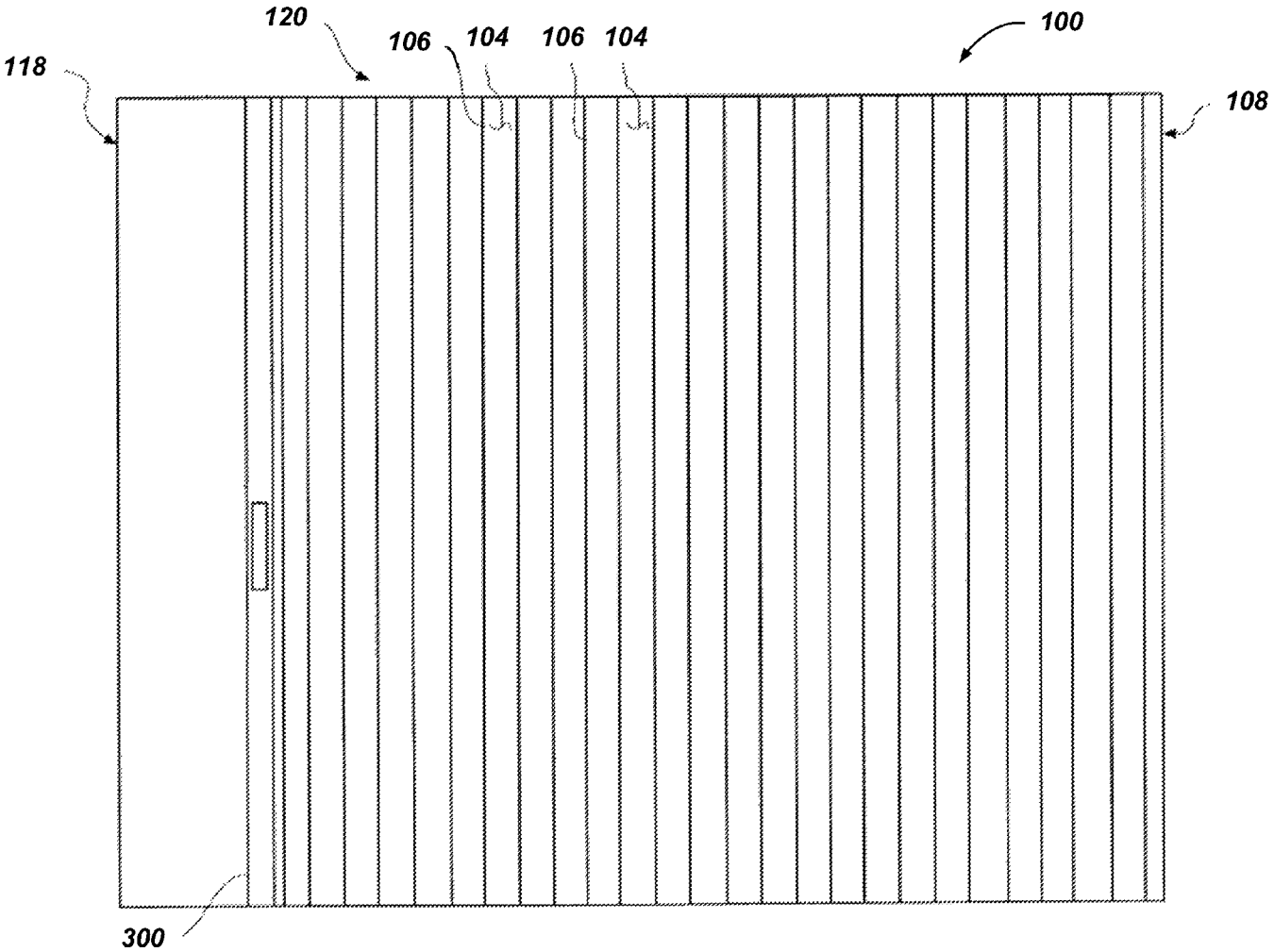
Figure 1C:
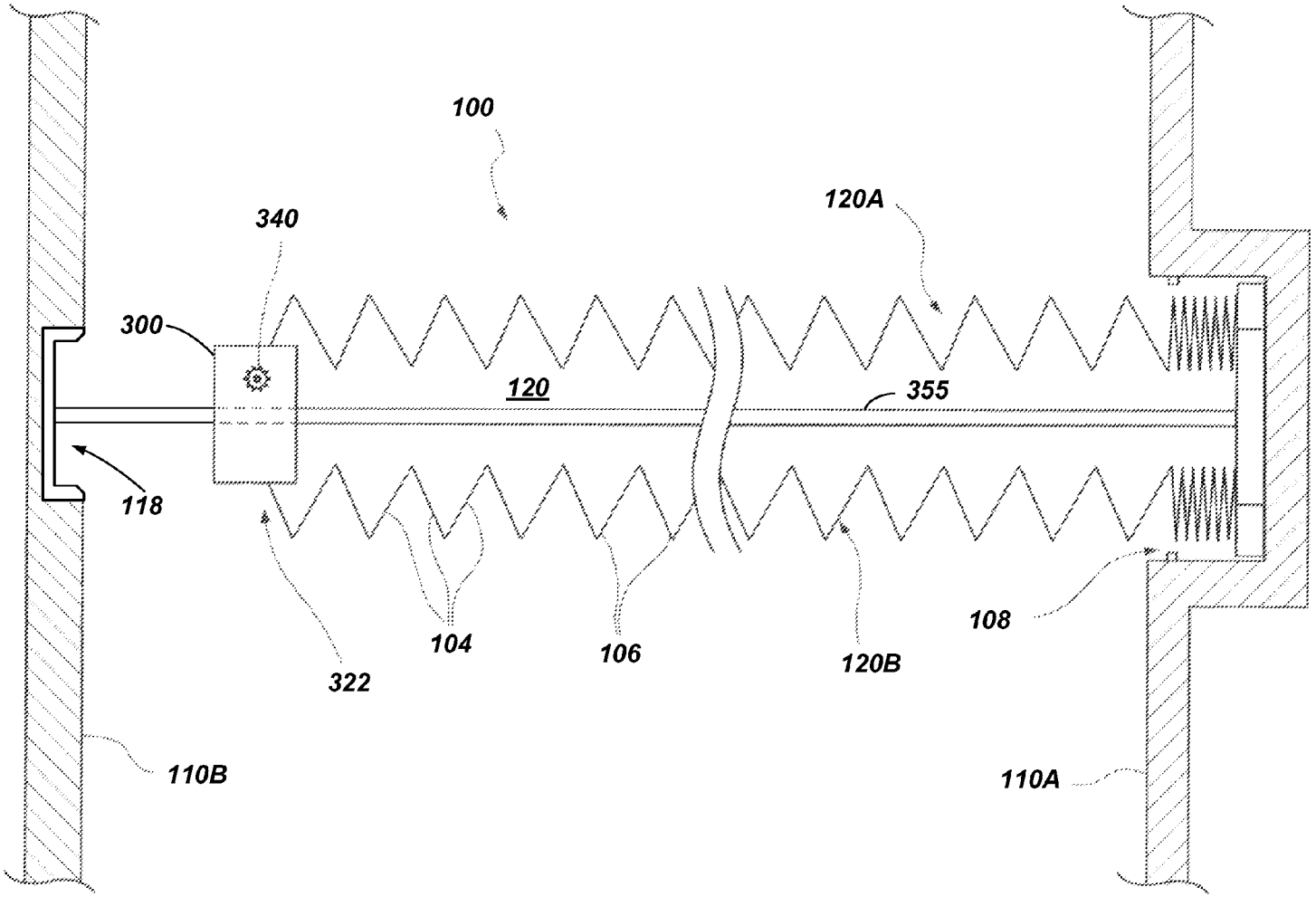

FIGS. 1A-1C illustrate an embodiment of a movable partition system 100 of the present disclosure. The movable partition system 100 is an automatic movable partition system, in that the system 100 includes a movable partition 120 that may be automatically extended, automatically retracted, or both automatically extended and automatically retracted. The movable partition 120 may be used for partitioning space, as a sound barrier, as a fire barrier, as a security barrier, for combinations of such purposes, or for other purposes.

The movable partition 120 may comprise, for example, an accordion-type door, as shown in FIGS. 1A-1C. The movable partition 120 may be formed with a plurality of panels 104 that are connected to one another with hinges or other hinge-like members 106. The hinged connection of the panels 104 allows the panels 104 to fold, and the movable partition 120 to collapse, as the movable partition 120 is retracted, which allows the movable partition 120 to be compactly stored in a pocket 108 (may also be referred to herein as a storage compartment) formed in a wall 110A of a building when in a retracted or folded state. In other embodiments, the movable partition 120 may comprise a sliding door, or another type of movable partition 120. As a non-limiting example, the panels 104 may be configured in a manner that they interlock, while still allowing the pivoting between the panels 104 where they are interlocked. For simplicity in explanation, and not for limitation, the pivot-like coupling may be referred to herein as using hinges 106 or couplings 106.

When it is desired to deploy the movable partition 120 to an extended position, the movable partition 120 is driven along a track 114 or track assembly across the space to provide an appropriate barrier. When in a deployed or an extended state, a leading edge of the movable partition 120, shown in the presently described embodiment as a male lead drive box 300, matingly (i.e., complementarily) engages with a jamb or recessed striker 118 that may be formed in a wall 110B of a building. In other embodiments, the lead drive box 300 may simply meet flush with the wall 110B. In some embodiments, the lead drive box 300 and movable partition 120 may extend longitudinally substantially from the track 114 on one surface (e.g., a ceiling) to an opposing surface 134 (e.g., a floor).

As can be seen in FIG. 1C, the movable partition 120 may include a first sheet 120A of panels 104 and a second sheet 120B of panels 104 that is laterally spaced from the first sheet 120A. Such a configuration may be utilized as a fire door wherein one sheet 120A acts as a primary fire and smoke barrier, a space between the two sheets 120A and 120B acts as an insulator or a buffer zone, and the second sheet 120B acts as a secondary fire and smoke barrier. Such a configuration may also be useful in providing an acoustical barrier when the movable partition 120 is used to subdivide a larger space into multiple, smaller rooms.

The lead drive box 300, which may include, for example, a drive mechanism 322 with one or more rotatable drive members 340 for coupling to a fixed drive member 355, which may be configured to open and close the movable partition 120 upon actuation thereof. The movable partition system 100 may further include various sensors and switches to assist in the control of the movable partition 120 through appropriate connection with a motor (not shown).

It is also noted that, while the exemplary embodiment shown and described with respect to FIGS. 1A-1C is directed to a single movable partition 120, other movable partitions may be utilized. For example, a two-door, or bi-part door, system may be utilized wherein two similarly configured doors extend across a space and join together to form an appropriate barrier. Also, the present disclosure may be applicable to movable partitions or barriers other than the accordion-type doors that are shown and described herein in example embodiments.

Figure 2:
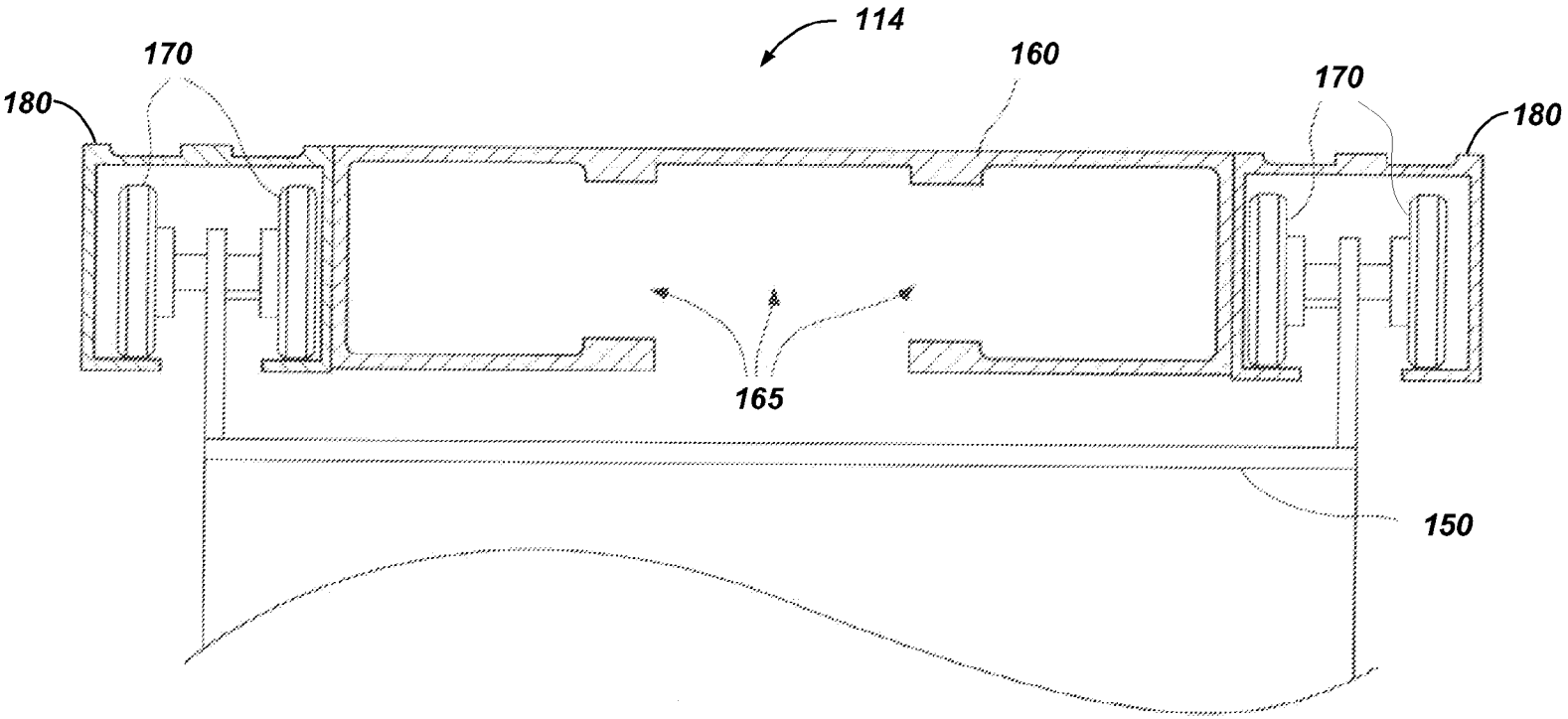
FIG. 2 shows a cross-section view of a track that may be used when accompanied with an embodiment of the present disclosure.

FIG. 2 shows a cross-section view of a track 114 that may be used when accompanied with an embodiment of the present disclosure. The track 114 is illustrated merely as an example of a type of track that may be used with movable partitions 120 with embodiments of the present disclosure. A support system may comprise the track 114, which may comprise an elongated drive guide member 160 located generally centrally in the track 114, and two elongated roller guide members 180 disposed on opposite lateral ends of the elongated drive guide member 160. In some embodiments, the drive guide member 160 and roller guide members 180 may comprise separate bodies or structures that are attached to one another, or simply installed proximate one another. In other embodiments, the drive guide member 160 and roller guide members 180 may comprise different regions of a single, unitary body or structure.

The drive guide member 160 may comprise a hollow body having internal surfaces defining a drive channel 165 that extends longitudinally through the drive guide member 160 and is located generally centrally in the track 114. The drive channel 165, also known as an internal channel, defined by the drive guide member 160, may be used to at least partially house rollers (e.g., wheels), drive mechanism components (e.g., a fixed drive member), or other components of the movable partition system 100 (not shown). Each of the roller guide members 180 may also comprise a hollow body having internal surfaces defining internal roller channels that extend longitudinally through each roller guide member 180 and are located at opposing lateral ends of the drive guide member 160. The roller channels may be partially defined by a bottom surface and innermost side surfaces internal to the roller guide members 180. Thus, the bottom and innermost side surfaces may define portions of the internal roller channels of the track 114. Portions of the movable partition system 100, such as, for example, the movable partition 120 and the lead drive box 300 (see FIG. 1C), may be suspended from (i.e., hang from) a trolley 310 (FIG. 3) (also referred to herein as a partition support member 150 (FIG. 2)) and move along the track 114 by the rolling of partition support rollers 170 (FIG. 2) (e.g., wheels or bearings) within and along the roller channels that extend through the roller guide members 180 of the track 114 in a direction at least substantially parallel to a direction of movement of the movable partition 120.

Figure 3:
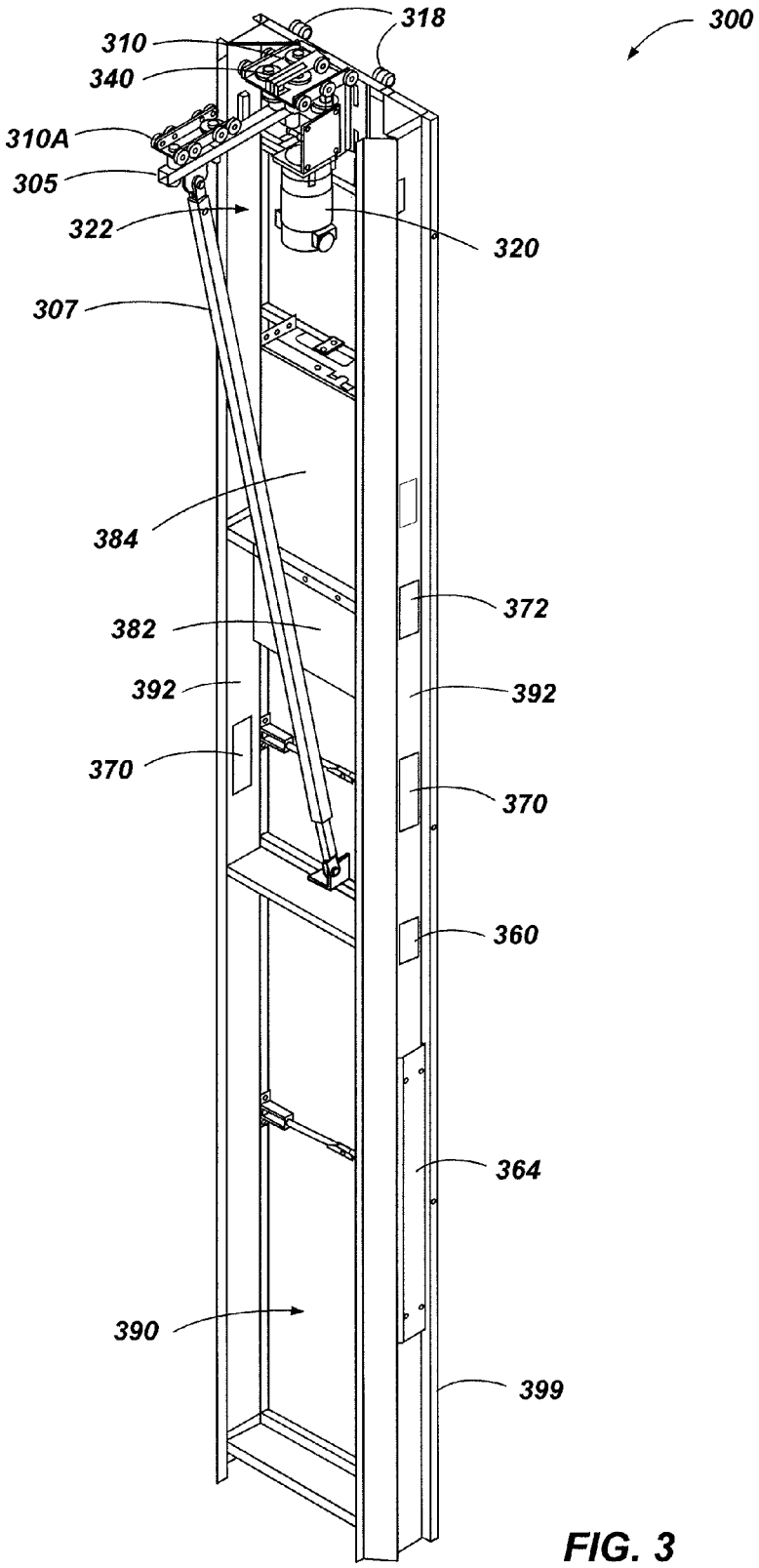
FIG. 3 is a perspective view of a lead drive box for coupling to a movable partition.
Figure 4:
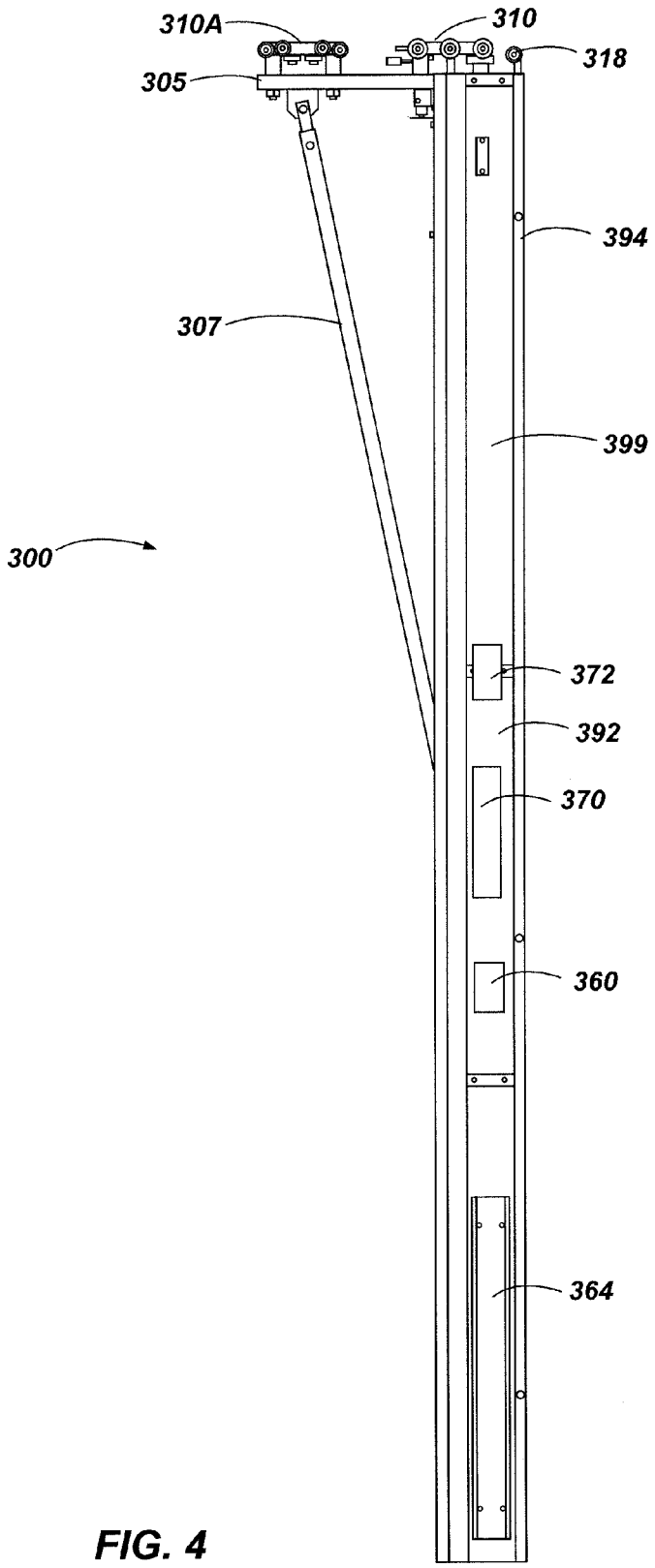
FIG. 4 is a side view of a portion of the lead drive box of FIG. 3.
Figure 5:
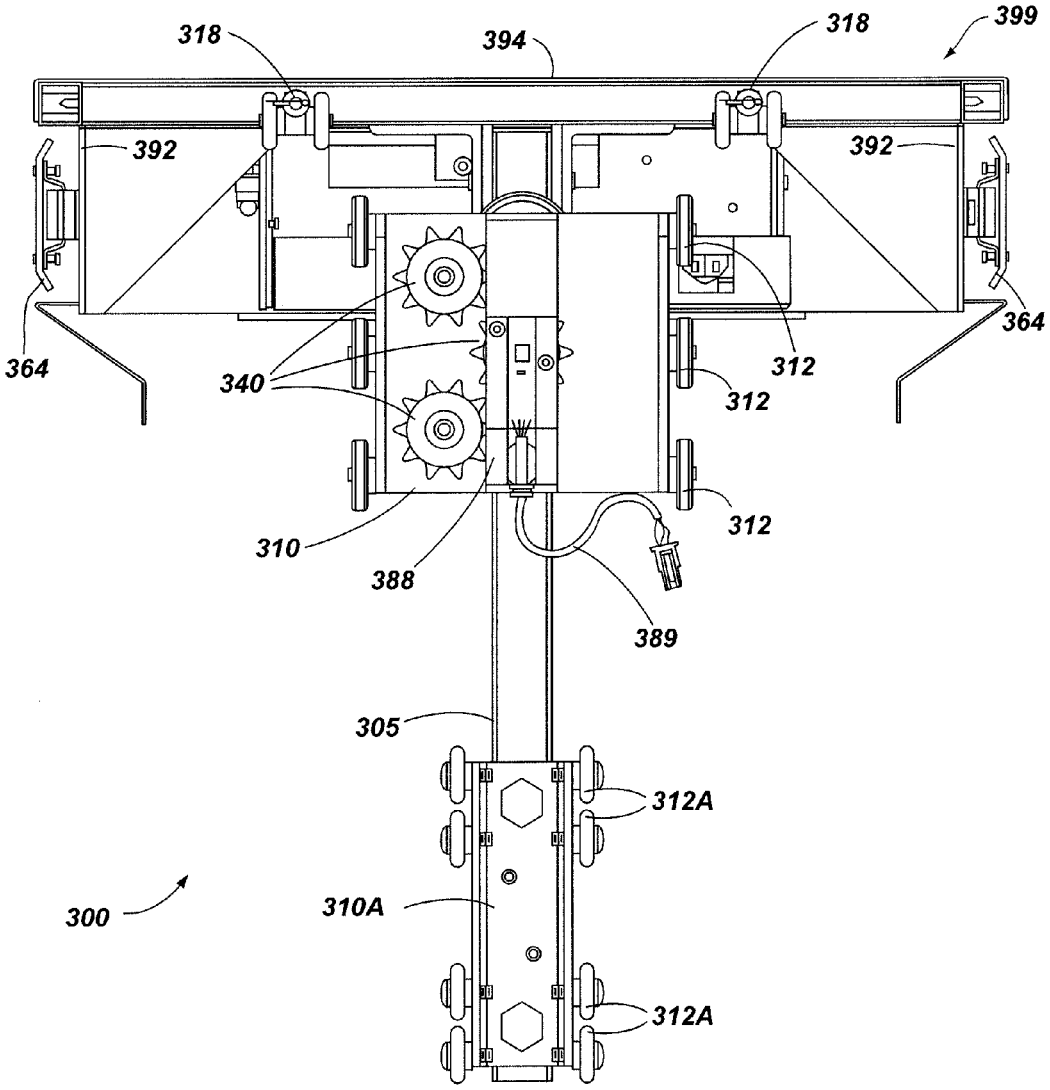
FIG. 5 is a top view of the lead drive box of FIG. 3.

FIG. 3 is a perspective view of the lead drive box 300 for coupling to the movable partition 120 (FIGS. 1A-1C). FIG. 4 is a side view of a portion of the lead drive box 300 and FIG. 5 is a top view of the lead drive box 300. FIGS. 3, 4, and 5 are referred to together in describing the lead drive box 300.

The lead drive box 300 may include a trolley 310 coupled to a support bar 305 and configured for coupling with the drive channel 165 (FIG. 2). The drive mechanism 322 may include the rotatable drive member 340 connected to a drive shaft of a motor 320, such that the motor 320 may be used to drive rotation of the rotatable drive member 340. As discussed in further detail below, the rotatable drive member 340 may be positioned adjacent the track 114 (FIG. 2) (e.g., within the drive channel 165 of the track 114), and may be configured to interact with an elongated, fixed drive member 355 (shown in FIG. 1C) such as, for example, a fixed chain, also positioned adjacent the track 114.

The drive mechanism 322 may hang from the trolley 310 and move along the track 114 (FIG. 2) by the rolling of trolley wheels 312 attached to the trolley 310. The trolley 310 and trolley wheels 312 may be disposed fully or partially within the drive channel 165 (FIG. 2) in the track 114. The rotatable drive member 340 may also be disposed within the drive channel 165 of the track 114. The elongated, fixed drive member 355 (FIG. 1C), which, in some embodiments, may comprise a chain fixed in place, may be disposed within the track 114 so as to be engaged with the rotatable drive member 340 when the drive mechanism 322 is in an engaged state. In this configuration, when the motor 320 drives the rotatable drive member 340 and the rotatable drive member 340 is engaged with the fixed drive member 355, the movable partition 120 (FIGS. 1A-1C) is extended or retracted along the track 114.

A diagonal bar 307 may be attached to the support bar 305 and the lead drive box 300. Thus, the lead drive box 300, support bar 305, and diagonal bar 307 may form a triangle to structurally support the drive mechanism 322, the lead drive box 300 and components encased therein. In some embodiments, an additional trolley 310A with additional trolley wheels 312A may be included near where the support bar 305 and the diagonal bar 307 meet to provide additional support and guidance for the lead drive box 300 as it traverses the track 114 (FIG. 2).

As illustrated, the rotatable drive member 340 includes three sprocket gears through which a chain, such as the fixed drive member 355 (FIG. 1C), may be threaded. Of course, fewer or more gears and sprockets may be used.

When the rotatable drive member 340 is engaged with the fixed drive member 355, the rotation of the rotatable drive member 340 causes the movable partition 120 to be pulled or pushed along the track 114 (FIG. 2) of the movable partition system 100 into a desired position. FIG. 1C shows the fixed drive member 355 as a fixed chain that is complementary to the teeth of a sprocket that serves as the rotatable drive member 340. The fixed drive member 355 may be fixed at both longitudinal ends of the track 114, such as in the pocket 108 in the wall 110A and at the jamb or recessed striker 118 in the wall 110B. The fixed drive member 355 may further be secured to the track 114 intermittently or continuously along its length for increased stability.

In additional embodiments, the fixed drive member 355 (FIG. 1C) may comprise a rack and the rotatable drive member 340 may comprise a pinion, or the fixed drive member 355 may comprise a belt and the rotatable drive member 340 may comprise one or more pulleys. Any of these configurations or their equivalents may be used to drive the movable partition 120 (FIGS. 1A-1C) along the track 114 (FIG. 2) in accordance with embodiments of the present disclosure.

An optional gearbox (not shown) may be installed between the motor 320 and the rotatable drive member 340. The gearbox may be desirable for better control or increased power when driving the rotatable drive member 340, for example. In embodiments that use a gearbox, the motor 320 may drive a drive shaft, which is also the input shaft for the gearbox. The gearbox may transfer the power from the motor 320 to the drive shaft. The drive shaft may be connected to the rotatable drive member 340 to drive the rotation of the rotatable drive member 340. When the rotatable drive member 340 is engaged with the fixed drive member 355 (FIG. 1C), the rotation of the rotatable drive member 340 causes the movable partition 120 to be pulled or pushed along the track 114 of the movable partition system 100. The drive mechanism 322 may not include a gearbox in some embodiments. In such embodiments, the motor 320 may drive the drive shaft directly, which is attached to the rotatable drive member 340.

In some embodiments, a clutch (not shown) may be operatively connected, such that a drive shaft of the motor 320 drives the rotation of a drive shaft (i.e., output) of the clutch when the clutch is in an engaged state. The rotatable drive member 340 may be operatively connected to the drive shaft of the clutch, such that the motor 320 may be used to drive rotation of the rotatable drive member 340 when the clutch is engaged. In other embodiments, there may be no clutch device installed between the motor 320 and the rotatable drive member 340.

As a non-limiting example, the motor 320 may include a brushed DC motor and the gearbox may include a planetary gearbox. Of course, it will be appreciated by those of ordinary skill in the art that other components may be used for the motor 320 and gearbox in practicing the described embodiment. Additionally, other mechanisms may be used for driving the movable partition 120 (FIGS. 1A-1C) along the track 114 (FIG. 2).

A casing 399 may be attached to the trolley 310, support bar 305, diagonal bar 307, or combinations thereof, to form at least a partial enclosure 390. As seen in FIG. 5, the casing 399 may include a front side 394 and two opposing sides 392 that extend substantially perpendicular from the front side 394 and run substantially parallel with a direction of travel defined by movement of the trolley 310 in the track 114. The front side 394 may engage with the wall 110B or the recessed striker 118 (FIG. 1C) and in some embodiments the front side 394 may be substantially planar. As seen in FIG. 1A, the lead drive box 300 may extend from the track 114 to the opposing surface 134. In addition, when stacked, the lead drive box 300 may be configured and sized such that the front side 394 may substantially fill, and possibly be flush with, the front of the pocket 108 in the wall 110A (FIG. 1C), which may eliminate the need for pocket cover doors to hide the folding door when not in use.

The lead drive box 300 may also include box roller assemblies 318, which may be attached to the trolley 310, support bar 305, diagonal bar 307, casing 399, or combinations thereof, and be configured for engaging with the drive channel 165 (FIG. 2) or channels for the partition support rollers 170 (FIG. 2).

Figure 6:
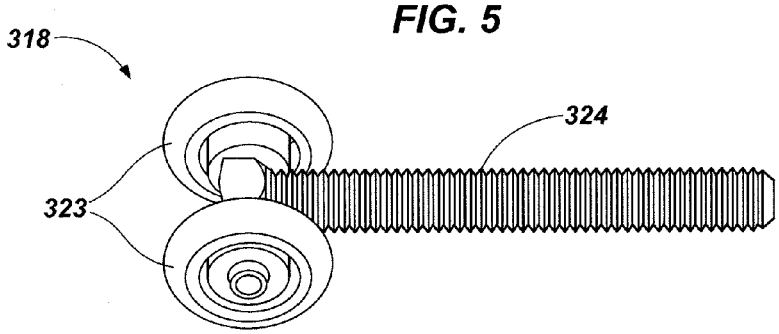
FIG. 6 illustrates a possible embodiment of box roller assemblies for the lead drive box.

FIG. 6 illustrates a possible embodiment of the box roller assemblies 318. In this embodiment, the box roller assemblies 318 may include rollers 323 and an adjustment mechanism 324 (e.g., a threaded attachment member) for adjustment when attached to the lead drive box 300 such that the lead drive box 300 can be plumbed in relation to the "pocket" wall 110A (FIG. 1C), the "strike" wall 110B (FIG. 1C), or a combination thereof. Other embodiments of the lead drive box 300 may also include similar adjustment mechanisms for the trolley wheels (312 and 312A) of the trolleys (310 and 310A) to enable alternative or additional adjustment points of the plumb angle of the lead drive box 300.

Figure 7:
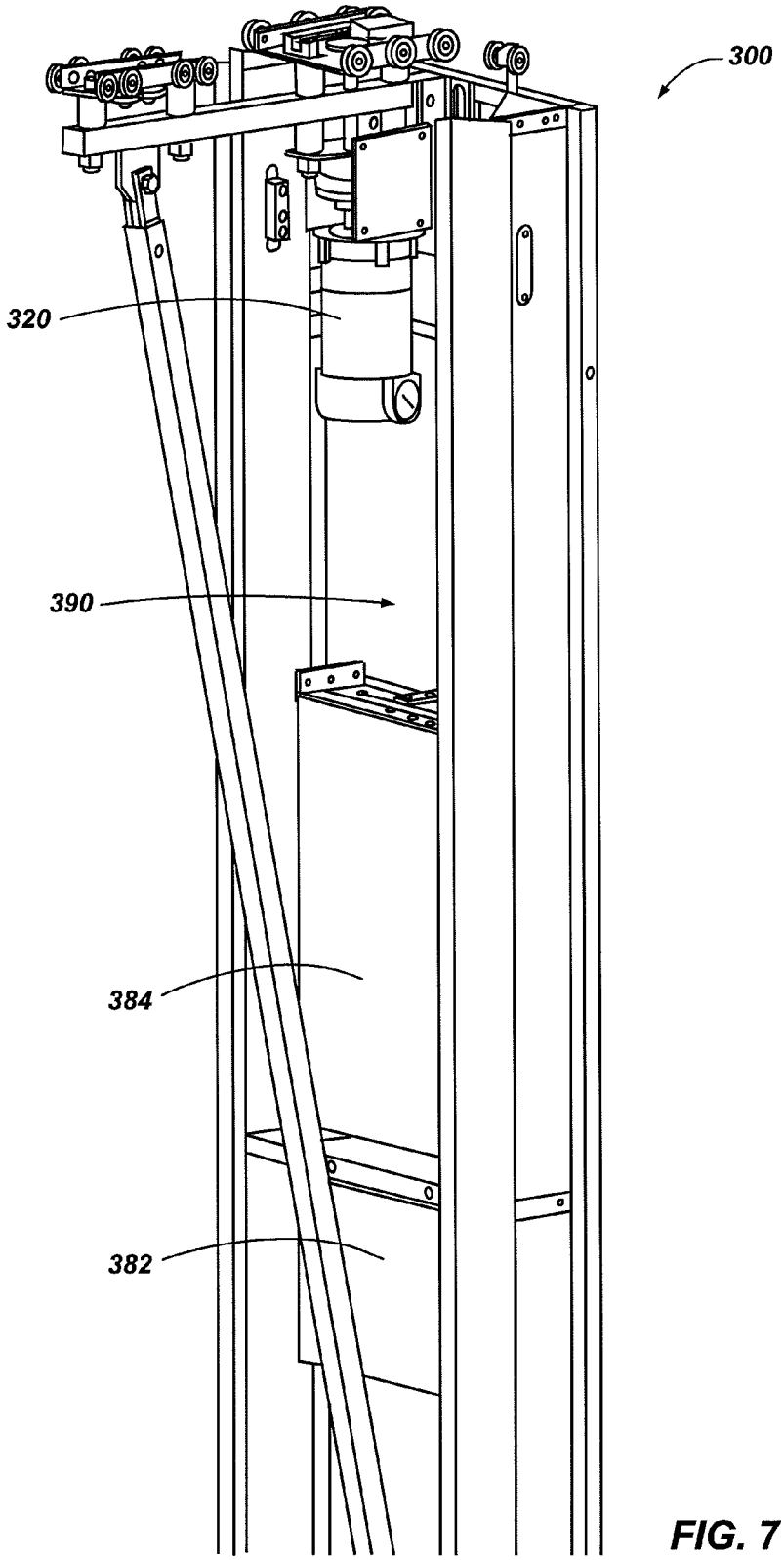
FIG. 7 is a perspective view of a portion of the lead drive box showing possible locations for electrical components modules.
Figure 8:
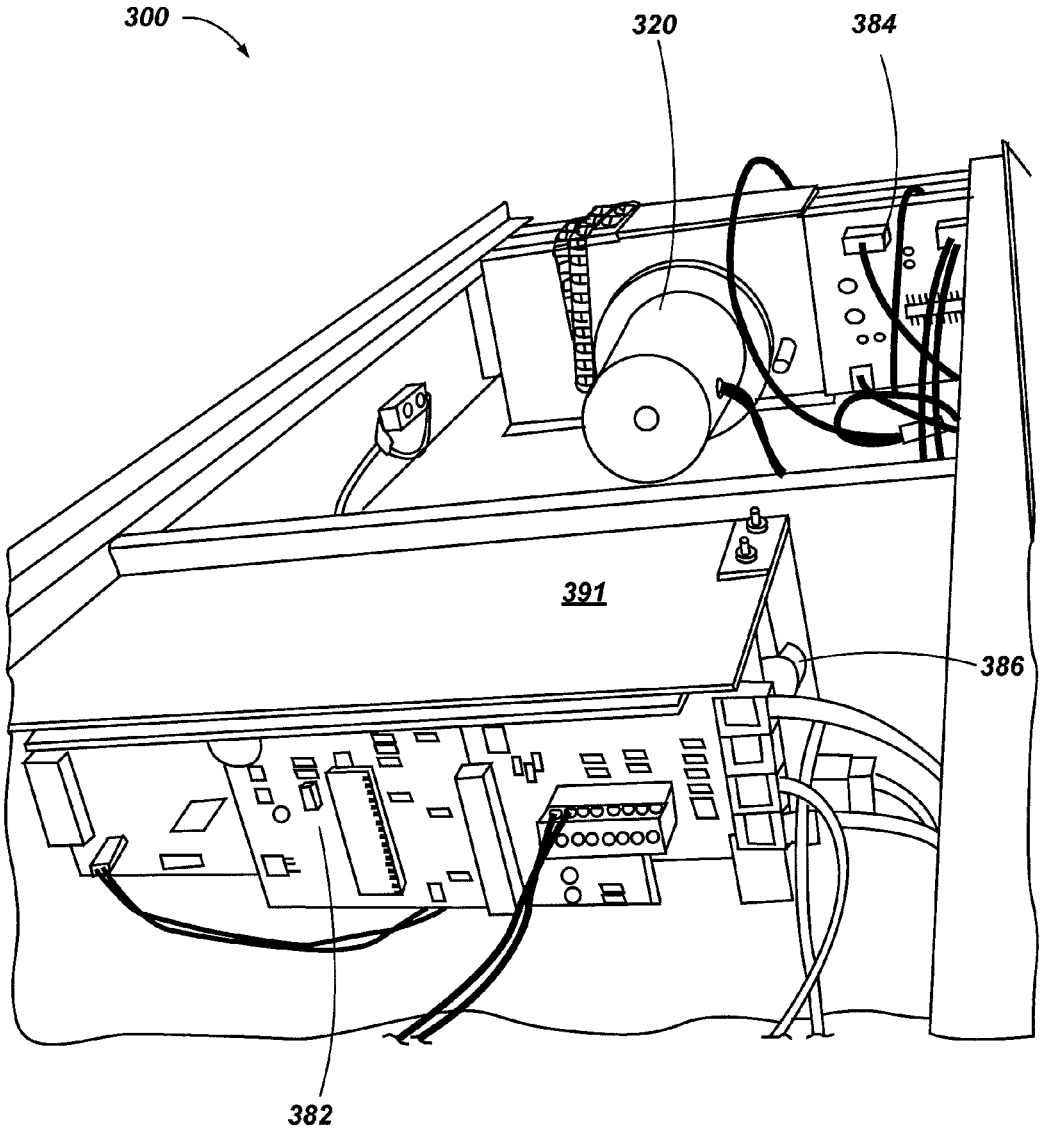
FIG. 8 is another perspective view of a portion of the lead drive box showing electrical components modules disposed in the lead drive box.

FIG. 7 is a perspective view of a portion of the lead drive box 300 showing possible locations for electrical components modules. FIG. 8 is another perspective view of a portion of the lead drive box 300 showing electrical components modules disposed in the lead drive box 300. In FIG. 8, a motor control module 384 with electrical and electronic components for controlling operation of the motor 320 is illustrated. A post control module 382 with electrical and electronic components for controlling other operations of the lead drive box 300 is also illustrated.

These other operations may include operations such as receiving input from various sensors, switches, buttons, or other sources of control signals and command signals. In some embodiments, these control signals, command signals and sensor signals may be multiplexed together with a multiplexer board 386 to save wiring between modules such as the post control module 382 and the motor control module 384.

The various electrical component modules (e.g., the motor control module 384, post control module 382, and multiplexer board 386) and the motor 320 may be configured to fit substantially within the partial enclosure 390 (FIG. 7) of the lead drive box 300. In addition, optional partial covers 391 (FIG. 8) may be configured for holding, covering, or a combination thereof, of one or more electrical components modules in the form of the motor control module 384, the post control module 382, the multiplexer board 386, and various combinations thereof.

In conventional movable partitions many of the electrical components are disposed in one or both walls 110A and 110B (FIG. 1C). For example, some conventional movable partitions may include a motor, various switches, various sensors, and control electronics at either end of the track.

In contrast, in embodiments of the present disclosure, the motor 320, various switches, various sensors, and control electronics may all be carried by the lead drive box 300. Thus, there is no need for wires carrying signals between the walls 110A and 110B (FIG. 1C) and to the lead drive box 300. This integrated arrangement in the lead drive box 300 creates many benefits.

As non-limiting examples, the integrated lead drive box 300 may be completely configured and tested as an integrated drive assembly before shipping such that assembly in the field may require as little as attachment to the track 114 (FIG. 2) and attachment to power wires. Testing and repair may be much simpler because all of the drive elements are located in the same assembly. For example, some installation regulations may require a clearance (e.g., 3 feet) around operational components for access by a technician. This clearance requirement can cause problems with components installed in a wall 110A or 110B. However, with embodiments of the present disclosure, the lead drive box 300 may be moved partially along the track 114 for easy access to all sides and areas of the lead drive box 300 and the components carried thereby.

The embodiment of FIG. 7 illustrates a longitudinal arrangement of the motor 320, the motor control module 384 and the post control module 382 within the partial enclosure 390. This longitudinal arrangement can reduce space and enable the overall dimensions of the lead drive box 300 to be much smaller by efficiently utilizing the volume available in the longitudinal direction. In the embodiment of FIG. 8, more space may be available allowing placement of the motor control module 384 side-by-side with the motor 320. Of course, many other configurations, combinations, and placements of the various control electronics (e.g., the motor control module 384, post control module 382, and multiplexer board 386) are possible within the partial enclosure 390 region of the lead drive box 300.

The various electrical components modules may include a variety of electrical and electronic components such as, for example, transistors, relays, resistors, capacitors, inductors, multiplexers, microprocessors, microcontrollers, and memory for carrying out functions of the motor 320 and lead drive box 300.

With embodiments of the present disclosure, control switches and sensors can be carried with the lead drive box 300 rather than positioned on or within the walls 110A and 110B. As non-limiting examples, some of the controls, switches, sensors, and control electronics are shown in FIGS. 3-8 and discussed herein. Of course, other controls, switches, and sensors may be used and the control electronics may be configured with different partitioning from those discussed herein.

The movable partition 120 (FIGS. 1A-1C) may include an emergency actuator 364 (e.g., a switch), commonly referred to as "panic hardware." Operation of the emergency actuator 364 allows a person to cause the door to retract, open, or open partially if it is closed, or to stop while it is closing, allowing access through the barrier formed by the movable partition 120 for a predetermined amount of time. Moreover, the movable partition system 100 (FIGS. 1A-1C) may further include, or may be associated with, an alarm system which, upon providing an appropriate signal, results in deployment or retraction of the movable partition 120 depending on the specific situation.

In some embodiments, as shown in FIG. 5, the emergency actuator 364 may be positioned on one or more of the two opposing sides 392 of the casing 399. As a result, when the movable partition system 100 is stacked, the lead drive box 300 may substantially fill, and possibly be flush with, the front of the pocket 108 in the wall 110A (FIG. 1C), which would position the emergency actuator 364 in a protected position within the pocket 108. This protected position may help protect the emergency actuator 364 and related hardware from damage or destruction during operation of the movable partition system 100 as well as environmental elements when the movable partition system 100 is stacked within the pocket 108.

Other user-controlled switches 360 may also be included such as, for example, a general operation switch and keyed switch. The keyed switch may be used by authorized personal such as facility managers or Fire Department personnel for controlling operation of the movable partition 120 (FIGS. 1A-1C). The general operation switch may be used by any person for controlling operation of the movable partition 120. As non-limiting examples, the user-controlled switches 360 and the emergency actuator 364 may directly, or indirectly through electrical components modules, generate movement signals such as an open-or-close command, a stop-or-go command, or an emergency command.

As seen in FIGS. 3 and 4, vision panels 370 (may also be referred to as light kits) may be included as a cutout or window on each of the opposing sides 392 so that a person can see a region on the other side of the movable partition 120 (FIGS. 1A-1C). For example, the vision panels 370 may be useful for verifying that is safe to operate the movable partition 120 based on what can be seen of the region on the other side.

A door display 372 may be included to present various status messages to the user about operation of the lead drive box 300, temperature or other environmental information on either side of the movable partition 120, or other information.

Determination of the position of the lead drive box 300 may be desirable so that the automatic movable partition system 100 (FIGS. 1A-1C) may be able to properly control the engagement of the lead drive box 300 with the jamb or recessed striker 118 (FIG. 1C), the opening and closing of the movable partition 120 (FIGS. 1A-1C), driving of the movable partition 120 to a desired position, and combinations thereof. This control may be useful after the movable partition 120 has been manually moved by maintenance personnel or a firefighter, for example. An encoder 388 is illustrated in FIG. 5 as disposed near one of the rotatable drive members 340, which may be engaged with the elongated, fixed drive member 355 (FIG. 1C). The encoder 388 may optically or magnetically track the number of revolutions or partial revolutions of the rotatable drive member 340. It can be determined how many revolutions the rotatable drive member 340 will make per unit length of the fixed drive member 355 (e.g., inches or feet), and by determining how many revolutions the rotatable drive members 340 has made, it can be determined how far the rotatable drive members 340 has traveled along the fixed drive member 355. The encoder 388 may be coupled with the electrical components modules via a connection 389 to calculate the position of the movable partition 120.

In one embodiment, the encoder 388 may include an optical encoder using an LED to emit light onto a codewheel surface, projecting an image back on a photodetector, causing the output to change as the rotatable drive member 340 rotates. However, it will be appreciated by those of ordinary skill in the art that other components may be used for the encoder 388.

While the invention is susceptible to various modifications and implementation in alternative forms, specific embodiments have been shown by way of examples in the drawings and have been described in detail herein. However, it should be understood that the invention is not intended to be limited to the particular forms disclosed. Rather, the invention includes all modifications, equivalents, and alternatives falling within the scope of the following appended claims and their legal equivalents.

What is claimed is:

1. A lead drive box for use with a movable partition, comprising:

at least one trolley coupled to the lead drive box and configured for disposition at least partially within a track extending longitudinally between a first end and a second end;

a motor coupled to the lead drive box;

a rotatable drive member coupled to the lead drive box, operably coupled to the motor, and configured for engaging a fixed drive member extending along the track to motivate the lead drive box and the movable partition attached thereto along the track when engaged with the motor and the motor is rotating;

an electrical components module disposed within the lead drive box and configured for controlling operation of the motor responsive to one or more signals originating from one or more sources; and a casing coupled to the at least one trolley and forming at least a partial enclosure for the lead drive box and configured for bearing the electrical components module and the one or more sources, wherein the motor and the electrical components module are offset from each other in a direction substantially parallel to a length of the lead drive box, and substantially within the casing.

2. The lead drive box of claim 1, wherein the at least one trolley is further configured for bearing the motor and the rotatable drive member.

3. The lead drive box of claim 1, further comprising adjustable rollers operably coupled with the lead drive box for adjusting a plumb angle of the lead drive box.

4. The lead drive box of claim 1, wherein the casing includes opposing sides on opposite sides of the at least one trolley, the opposing sides substantially parallel with a direction of travel.

5. The lead drive box of claim 4, wherein the casing is configured to substantially fill a storage compartment for storing the movable partition and the lead drive box when not in use.

6. The lead drive box of claim 4, further comprising a vision panel through each of the opposing sides and configured for viewing a region on an opposite side of the movable partition.

7. The lead drive box of claim 4, further comprising one or more door displays on one or more of the opposing sides for displaying information about regions near the movable partition, information about operation of the lead drive box, or a combination thereof.

8. The lead drive box of claim 4, further comprising an emergency actuator borne by at least one of the opposing sides of the casing and operably coupled to the electrical components module.

9. The lead drive box of claim 1, wherein the casing extends substantially from the track to an opposing surface on at least three sides of the lead drive box.

10. The lead drive box of claim 9, wherein the at least three sides include a front side for engaging a wall when the movable partition is closed and opposing sides extending substantially perpendicular from the front side.

11. The lead drive box of claim 10, wherein the front side is substantially planar.

12. The lead drive box of claim 1, wherein the electrical components module includes a motor control module coupled to the lead drive box and proximate the motor and a post control module disposed in a location within the lead drive box separate from the motor control module.

13. The lead drive box of claim 1, wherein the electrical components module further includes a multiplexer configured to multiplex command signals from the electrical components module, the one or more signals originating from the one or more sources, or combinations thereof.

14. The lead drive box of claim 1, wherein the one or more sources include at least one of:

an emergency actuator indicating an emergency command and the control electronics is configured to at least partially open the movable partition responsive to the emergency command;

a user-controlled switch indicating an open-or-close command and a direction of rotation of the motor is controlled responsive to the open-or-close command; and another user-controlled switch indicating a stop-or-go command and rotation of the motor is controlled responsive to the stop-or-go command.

15. A movable partition system comprising:

a movable partition engaged with and movable along a track extending longitudinally between a first end and a second end; and a lead drive box coupled to the movable partition and the track, the lead drive box configured to move along the track and move the movable partition along the track and comprising:

at least one trolley coupled to the lead drive box and configured for disposition at least partially within the track;

a motor coupled to the lead drive box;

a rotatable drive member coupled to the lead drive box, operably coupled to the motor, and configured for engaging a fixed drive member extending along the track to motivate the lead drive box and the movable partition attached thereto along the track when engaged with the motor and the motor is rotating;

an electrical components module disposed within the lead drive box and configured for controlling operation of the motor responsive to one or more signals originating from one or more sources carried by the lead drive box; and a casing coupled to the at least one trolley and forming at least a partial enclosure for the lead drive box and configured for bearing the electrical components module and the one or more signal sources, wherein the motor and the electrical components module are offset from each other in a direction substantially parallel to a length of the lead drive box, and substantially within the casing.

16. The movable partition system of claim 15, wherein the movable partition comprises a first accordion folding panel and a second accordion folding panel.

17. The movable partition system of claim 15, wherein the one or more sources include at least one of:

an emergency actuator indicating an emergency command and the control electronics is configured to at least partially open the movable partition responsive to the emergency command;

a user-controlled switch indicating an open-or-close command and a direction of rotation of the motor is controlled responsive to the open-or-close command; and another user-controlled switch indicating a stop-or-go command and rotation of the motor is controlled responsive to the stop-or-go command.

18. The movable partition system of claim 15, wherein the rotatable drive member comprises one of a sprocket and a gear and the fixed drive member comprises one of a chain and a belt having features complementary to, and configured to engage with, features of the rotatable drive member.

19. The movable partition system of claim 15, wherein the casing includes opposing sides on opposite sides of the at least one trolley and substantially parallel with a direction of travel.

20. The movable partition system of claim 19, further comprising a vision panel through each of the opposing sides and configured for viewing a region on an opposite side of the movable partition.

21. The movable partition system of claim 19, further comprising one or more door displays on one or more of the opposing sides for displaying information about regions near the movable partition, information about operation of the lead drive box, or a combination thereof.

22. The movable partition system of claim 19, further comprising an emergency actuator borne by at least one of the opposing sides of the casing and operably coupled to the electrical components module.

23. The movable partition system of claim 15, wherein the electrical components module includes a motor control module coupled to the casing and proximate the motor and a post control module disposed in a location within the lead drive box separate from the motor control module.

24. The movable partition system of claim 15, wherein the electrical components module further includes a multiplexer configured to multiplex command signals from the electrical components module, the one or more signals originating from the one or more sources, or combinations thereof.

25. A method of moving a movable partition along a track, comprising:

engaging a rotatable drive member carried by a lead drive box with a fixed drive member extending along the track and having fixed, laterally offset opposite ends;

actuating a motor at least substantially within the lead drive box to drive rotation of the rotatable drive member to move the lead drive box and the movable partition attached thereto along the track; and controlling operation of the motor with an electrical components module offset from the motor in a direction substantially parallel to a length of the lead drive box, and at least substantially within the lead drive box and responsive to one or more signals originating from one or more sources carried by the lead drive box.

26. The method of claim 25, further comprising encasing the lead drive box on at least three sides including a front side and opposing sides extending substantially perpendicular from the front side.

27. The method of claim 26, further comprising generating an emergency command from an emergency actuator disposed on at least one of the opposing sides and at least partially opening the movable partition responsive to the emergency command.

28. The method of claim 26, further comprising generating a movement signal including at least one of an open-or-close command and a stop-or-go command from a user-controlled switch disposed on at least one of the opposing sides and modifying behavior of the motor responsive to the movement signal.

29. The method of claim 26, further comprising enabling viewing through each of the opposing sides to a region on an opposite side of the movable partition with a vision panel in each of the opposing sides.

30. The method of claim 25, wherein engaging the rotatable drive member with the fixed drive member comprises engaging one or more sprockets with a chain, engaging one or more pulleys with a belt, or engaging a pinion gear with a rack gear.

31. The method of claim 25, further comprising displaying information, on one or more door displays carried by the lead drive box, about regions near the movable partition, information about operation of the lead drive box, or a combination thereof.

* * * * *